United States Patent [19]

Johnson et al.

[11] 4,027,457

[45] June 7, 1977

[54] FILM COVERED CUT ITEM AND PROCESS

[75] Inventors: James J. Johnson; David Y. Loeber, both of Louisville, Ky.

[73] Assignees: David Y. Loeber; Harry B. O'Donnell, III, both of Louisville, Ky.

[22] Filed: May 2, 1974

[21] Appl. No.: 466,137

Related U.S. Application Data

[63] Continuation of Ser. No. 251,204, May 8, 1972, abandoned.

[52] U.S. Cl. ..... 53/23; 53/123; 83/1

[51] Int. Cl.² ..... B65B 63/00; B26D 4/02

[58] Field of Search ..... 53/23, 123, 33; 83/13, 83/1; 99/171 LP, 233.11, 233.12, 450.2, 450.3, 233.1, 179, 171 R; 206/DIG. 2; 426/414, 518, 128, 124, 396

[56] References Cited

UNITED STATES PATENTS

| | | | |
|---|---|---|---|
| 1,405,401 | 2/1922 | Eger | 83/620 |
| 1,596,514 | 8/1926 | Anderson | 53/23 |
| 2,023,122 | 12/1935 | Chandler | 53/23 X |
| 2,116,845 | 5/1938 | Peck | 53/123 |
| 2,339,584 | 1/1944 | Rice | 53/23 X |
| 2,621,129 | 12/1952 | Ramsbottom et al. | 53/33 X |
| 2,741,414 | 4/1956 | Nottage | 99/171 TC |
| 3,023,557 | 3/1962 | Tannehill et al. | 53/123 |
| 3,026,209 | 3/1962 | Niblaek et al. | 206/45.33 X |
| 3,026,657 | 3/1962 | Williams et al. | 53/23 |
| 3,477,194 | 11/1969 | Corrsin | 53/33 |
| 3,587,839 | 6/1971 | Von Brecht | 99/171 LP X |
| 3,679,509 | 7/1972 | Fielibert | 99/171 LP X |
| 3,692,544 | 9/1972 | Dendrinos | 206/DIG. 29 X |
| 3,771,713 | 11/1973 | Davidson | 229/27 |
| 3,788,030 | 1/1974 | Moline | 53/123 |

*Primary Examiner*—Othell M. Simpson
*Assistant Examiner*—Horace M. Culver
*Attorney, Agent, or Firm*—Harry B. O'Donnell, III

[57] ABSTRACT

This invention provides a process for cutting a film covered item without piercing the covering film. Basically, the process comprises the steps of mounting an item on a compressible base and covering the mounted item with a resilient film, and then contacting the mounted film covered item with cutting means under pressure such that the item is cut and the base is compressed by the cutter means without the covering film being pierced by the cutter means. The present invention is also directed toward the mounted film covered and cut item that is produced by this process.

10 Claims, 5 Drawing Figures

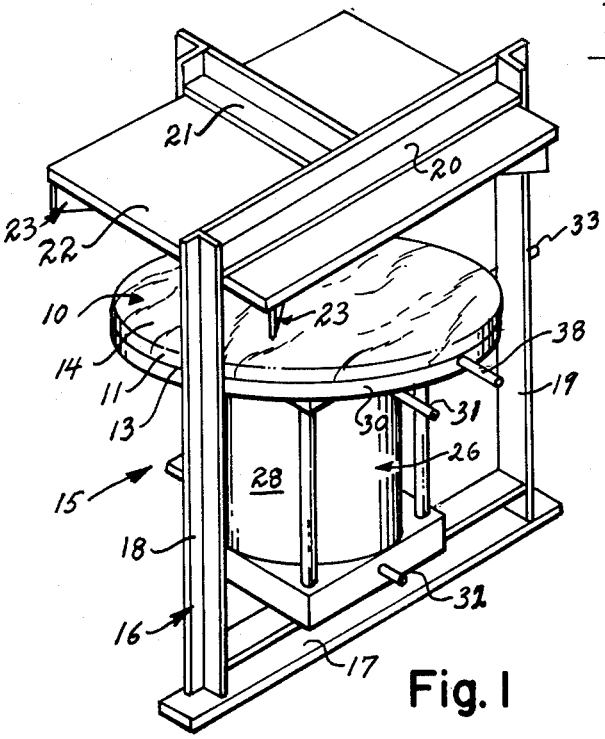
Fig. 1
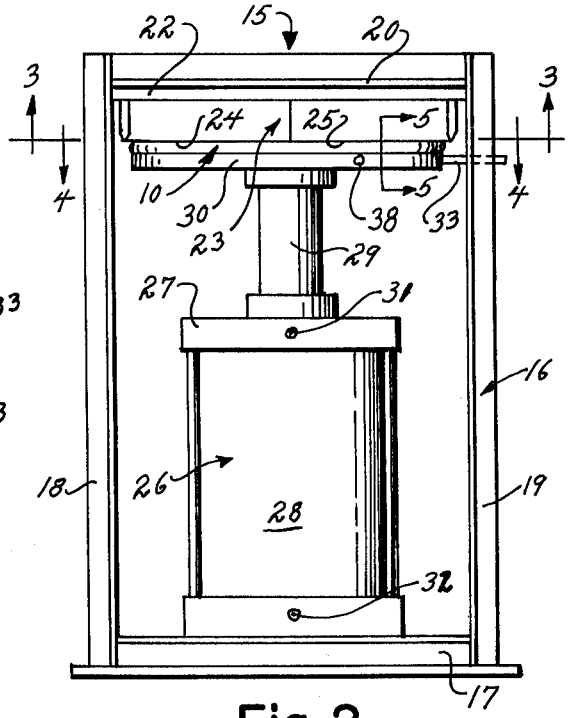
Fig. 2
Fig. 3
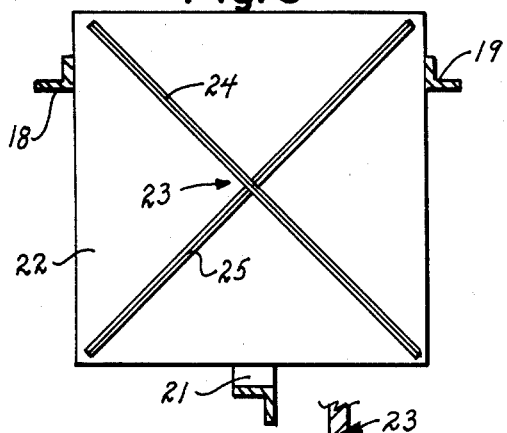
Fig. 4
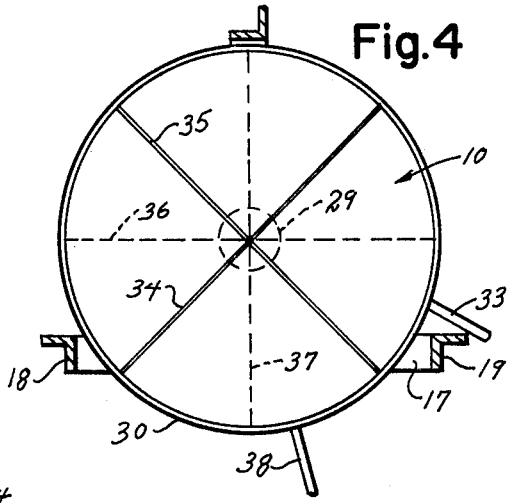
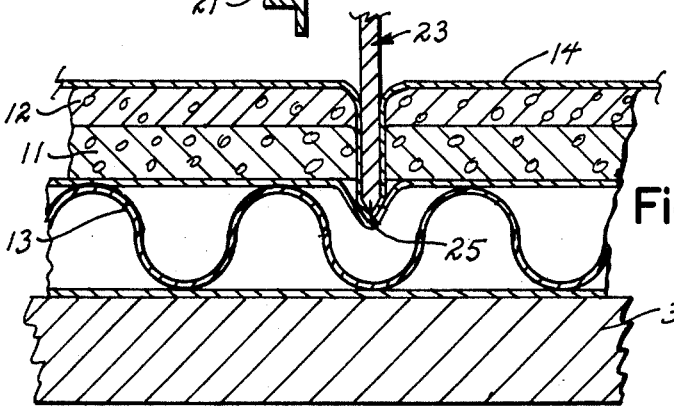
Fig. 5

FILM COVERED CUT ITEM AND PROCESS

This is a continuation of application Ser. No. 251,204, filed May 8, 1972, and now abandoned.

BACKGROUND OF THE INVENTION

This invention relates to the packaging of items and, more particularly, to a process for cutting a film covered item without piercing its covering film, and to the product by that process. Heretofore, it has been common practice to package an item by covering it with resilient film, such as polyvinylchloride and the like. It is frequently desired, for purposes of convenience to the consumer, that the film covered item be cut into plural portions before it is received by the consumer. In the past, it has been necessary that such cutting be performed prior to the covering of the item with the resilient film in order to avoid piercing of the film during the cutting operation. This prior-art requirement of precutting of the item prior to its being covered with the film has heretofore plagued the packaging industry with problems such as contamination, movement of the portions relative to one another, etc., during and between the cutting step and the subsequent film covering step. such prior-art problems have often resulted in waste of material and manpower.

SUMMARY OF THE INVENTION

The present invention provides a process for cutting a film covered item without piercing the covering film. Basically, the process comprises the steps of mounting an item on a compressible base and covering the mounted item with a resilient film, and then contacting the mounted film covered item with cutting means under pressure such that the item is cut and the base is compressed by the cutter means without the covering film being pierced by the cutter means. The present invention is also directed toward the mounted film covered and cut item that is produced by this process.

BRIEF DESCRIPTION OF THE DRAWING

The present invention is illustrated in the accompanying drawing, wherein:

FIG. 1 is an elevational perspective view showing a form of apparatus that can be utilized in performing the novel process of the present invention to provide the mounted film covered and cut product produced by it and illustrating the mounted and film covered item just prior to performance of the cutting step of the process;

FIG. 2 is an elevational view of the apparatus of FIG. 1, but showing the mounted and film covered item during performance of the cutting step of the process;

FIG. 3 is a sectional view taken along line 3—3 of FIG. 2;

FIG. 4 is a sectional view taken along line 4—4 of FIG. 2, with initial cuts made by the cutter means being shown in solid lines and optional additional cuts which can be made by the cutter means being shown in shadow lines; and FIG. 5 is a greatly enlarged fragmentary sectional view taken along line 5—5 of FIG. 2 showing details of the action of the cutter means under pressure upon the item and its compressible base and resilient film covering during performance of the cutting step of the process of the present invention.

DETAILED DESCRIPTION

Referring now to the drawing, and more particularly to FIGS. 1–2 and 4–5 thereof, there is illustrated a typical film covered item 10 which can be cut into plural portions without piercing its covering film by employing the novel process of the present invention. As shown, the film covered item 10 comprises a food confection, specifically a generally circular pizza pie, which includes a pastry crust 11 coated with a layer 12 of sauce, cheese and, optionally, other foods.

In accordance with a presently preferred mode of the process of the present invention and as best shown in FIG. 5, the uncut crust 11 is first mounted on a base 13, which is made of a compressible material, such as the illustrated corrugated cardboard or foamed plastic or the like, which has generally the same circular configuration and diameter as the crust 11. The uncut crust 11 is then coated with the layer 12 of the sauce, cheese, etc. Next, the coated and mounted uncut crust 11 is covered with a piece of resilient film 14, and the ends of the film piece 14 are drawn together and fastened to the outer or bottom surface of the compressible base 13 and sealed in a well known manner. While it is contemplated that various materials could be employed for the resilient covering film, good results have been obtained by utilizing 0.001 inch thick polyvinylchloride film supplied by Reynolds Metals Company of Richmond, Virginia.

The thus mounted and film covered item 10 is now ready for performance of the cutting or contacting step of the novel process of the present invention.

While it should be understood that various means could be employed, FIGS. 1–5 of the drawing illustrate a form of apparatus 15 that has been used with good results in performing the cutting or contacting step of the process of the present invention to cut the mounted film covered item 10 without piercing its covering film 14. The apparatus 15 comprises a frame 16 that includes a generally horizontally arranged bottom member 17 and two spaced apart uprights 18 and 19 which extend upwardly from the opposite ends of the bottom member 17. The frame 16 further comprises a pair of generally horizontally arranged top members 20 and 21. One of these top members 20 is arranged generally parallel to the bottom member 17, while the other top member 21 is arranged generally perpendicular to the center of the first top member 20. A generally horizontally arranged plate 22 is connected to the bottoms of the two top frame members 20 and 21. This plate 22 has cutter means 23 suspended from it which include a pair of generally vertical cutting edges 24 and 25 which are arranged to intersect one another at substantially a right (or 90°) angle (FIG. 3).

The frame 16 further mounts drive means 26 for contacting the mounted film covered item 10 that is to be cut with the cutter means 23 under pressure such that the previously uncut crust 11 and coating layer 12 of the item 10 will be cut and the mounting base 13 will be compressed by the cutter means 23 without the covering film 14 being pierced by the cutter means 23.

As best shown in FIGS. 1 and 2 of the drawing, the drive means 26 comprises a fluid motor, such as a so-called pneumatic cylinder motor or the like 27, which has its cylinder 28 fixed to the bottom frame member 17 by suitable fastening means, such as welding or the like. The fluid motor 27 further includes a piston (not shown) that is contained within the cylinder 28 and has a piston rod 29 connected to its upper end which extends upwardly through an opening in the top of the cylinder 28 and has a generally horizontally arranged ram 30 rotatably connected to its upper end.

In performing the cutting or contacting step of the process of the present invention with the apparatus 15, the ram 30 is first located in its retracted position (FIG. 1) by supplying pressurized fluid, e.g., 35–40 p.s.i. compressed air, to the interior of the cylinder 28 through its upper fluid inlet 31. The mounted film covered item 10 can then be supported centered on the retracted ram 30 with its compressible mounting base 13 lying atop the ram 30 and its covering film 14 facing the cutter means 23. As illustrated, the ram 30 is of substantially the same configuration and diameter as the mounted and film covered item 10 and has its radial center aligned with the intersection of the cutting edges 24 and 25 of the cutter means 23 and the central axis of the fluid motor piston rod 29.

Once the mounted film covered item 10 has been so located on the retracted ram 30, it can then be contacted under pressure with the fixed cutter means 23 such that the previously uncut crust 11 and coating layer 12 of the item 10 will be cut and the mounting base 13 will be compressed by the cutter means 23 without the covering film 14 being pierced by the cutter means 23 (FIG. 5) by commencing supply of the pressurized fluid to the interior of the cylinder 28 via its lower fluid inlet 32 while ceasing supply of such fluid to the cylinder upper fluid inlet 31. Preferably, this contacting or cutting is done with the retracted ram 30 (FIG. 1) having been first rotated about the central axis of the piston rod 29 by moving one of its two radially protruding handles 33 (clockwise as viewed in FIG. 4) into contact with one of the two frame uprights 19. This will cause the cutter means 23 to make the cuts 34 and 35 (shown in solid lines in FIG. 4) in the crust 11 and its coating layer 12 dividing the same into four segments or portions without piercing the covering film 14.

Optionally, additional cuts 36 and 37 (shown in shadow lines in FIG. 4) can then be made in the crust 11 and its coating layer 12 to divide the same into eight segments or portions without piercing the covering film 14 by retracting the ram 30, rotating it approximately 45° about the central axis of the piston rod 29 by manually moving its other handle 38 (counterclockwise as viewed in FIG. 4) into contact with the frame upright 19, and again contacting the film covered item 10 with the cutter means 23 through operation of the fluid motor 27.

Following completion of the aforedescribed cutting or contacting step or steps of the novel process of the present invention, the ram 30 is then moved to its retracted position (FIG. 1) through operation of the fluid motor 27, and the novel mounted film covered and cut item 10 thus produced by the novel process of the present invention is removed from the ram 30. If the item 10 is perishable, such as the illustrated pizza pie, it can now be frozen for preservation until ready for use by a consumer who can then remove the covering film 14 and, after heating, share a wholesome meal of the pre-sliced portions or segments of the crust 11 and its coating layer 12 with his family or friends.

It should be apparent that while there have been described what at present are considered to be preferred embodiments of this invention in accordance with the Patent Statutes, changes may be made in the disclosed modes and forms without actually departing from the true spirit and scope of this invention. It is, therefore, intended that the appended claims shall cover such modifications and applications that may not depart from the true spirit and scope of the present invention.

We claim:

1. A process for cutting a film covered item without piercing its covering film comprising the steps of:

a. mounting an item on a compressible base and covering said mounted item and at least a portion of said base with resilient film and fastening said film to said portion of said base, and, thereafter, b. contacting said mounted film covered item and said base with cutter means under pressure and thus causing said item to be cut and said base to be compressed by said cutter means without said covering film being pierced by said cutter means.

2. The invention of claim 1, wherein said item comprises food.

3. The invention of claim 2, wherein said food is a confection.

4. The invention of claim 2, wherein said food comprises pizza pie.

5. The invention of claim 1, wherein said compressible base comprises corrugated cardboard.

6. The invention of claim 5, wherein said film comprises polyvinylchloride.

7. The invention of claim 1, wherein said film comprises polyvinylchloride.

8. The invention of claim 1, wherein said contacting is performed by moving said mounted film coated item and base under pressure with relation to fixed cutter means.

9. The invention of claim 8, wherein said cutter means includes two blades arranged at substantially a right angle to one another such that the item will be cut into four portions by said contacting.

10. The invention of claim 9, wherein said contacting is performed with the item having its radial center substantially aligned with the intersection of said two blades.

* * * * *